US006299764B1

(12) United States Patent
White et al.

(10) Patent No.: US 6,299,764 B1
(45) Date of Patent: Oct. 9, 2001

(54) SANITARY FLOOR DRAIN

(75) Inventors: James E. White, South Hutchinson; Gregory A. Roepka, Hutchinson, both of KS (US)

(73) Assignee: Stainless Steel Systems, Inc., South Hutchinson, KS (US)

( * ) Notice: Subject to any disclaimer, the term of this patent is extended or adjusted under 35 U.S.C. 154(b) by 0 days.

(21) Appl. No.: 09/586,446

(22) Filed: Jun. 2, 2000

(51) Int. Cl.[7] ..... E03F 5/06

(52) U.S. Cl. ..... 210/164; 210/170; 210/305; 210/307; 404/4

(58) Field of Search ..... 210/163, 164, 210/170, 305, 307, 474; 404/4, 5; 52/302.1

(56) References Cited

U.S. PATENT DOCUMENTS

| | | | | |
|---|---|---|---|---|
| 185,017 | * | 12/1876 | Dark | 210/163 |
| 200,277 | * | 2/1878 | Gisel | 210/164 |
| 208,809 | * | 10/1878 | Gorman | 404/4 |
| 799,829 | * | 9/1905 | Church | 210/164 |
| 1,035,480 | * | 8/1912 | Schodde | 210/163 |
| 1,039,169 | * | 9/1912 | Meyer | 210/164 |
| 1,363,792 | * | 12/1920 | Johnston | 210/164 |
| 2,440,857 | * | 5/1948 | Hart | 404/4 |
| 3,066,802 | * | 12/1962 | Löffler | 210/163 |
| 3,713,539 | * | 1/1973 | Thompson et al. | 210/164 |

FOREIGN PATENT DOCUMENTS

| | | | |
|---|---|---|---|
| 1114446 | * | 9/1961 | (DE) . |
| 1646 | * | of 1881 | (GB) . |
| 663 | * | 1/1893 | (GB) . |

* cited by examiner

*Primary Examiner*—Christopher Upton
(74) *Attorney, Agent, or Firm*—Hovey, Williams, Timmons & Collins

(57) ABSTRACT

An improved floor drain assembly (10) is provided which includes an upright inlet section (12) presenting a waste inlet (30) and an outlet section (14) terminating in a discharge end (16). The assembly (10) includes an oblique first wall **(26*b*) below the inlet (30) for diverting waste materials towards the end (16); a second oblique wall (82) spaced from the wall (26*b*) and a third wall (28*a*) intermediate the walls (26*b*, 82) complete an in-line trap (18). The inlet (30) is equipped with a grate (46) and a perforate filter (50). The wall (26*b*) serves to forcefully divert waste material through the assembly (10)** to minimize clogging problems.

15 Claims, 3 Drawing Sheets

SANITARY FLOOR DRAIN

BACKGROUND OF THE INVENTION

1. Field of the Invention

The present invention is broadly concerned with an improved floor drain assembly of the type used in industrial plants such as meat packing houses and the like.

More particularly, the invention pertains to such drain assemblies which are inexpensively constructed and include, beneath the drain inlet, an obliquely inclined wall serving to forcefully divert waste towards the discharge end of the assembly to thus minimize the possibility of clogs. In addition, the assemblies hereof include a trap preferably made up of the inclined wall and an adjacent upright wall.

2. Description of the Prior Art

Large industrial operations such as packing houses are faced with severe drainage problems. The aqueous waste from such plants contains a high percentage of particulates of various sizes which must be accommodated. The drainage problems are of two different sources. First, the heavy volume of particulate-laden waste must be handled without continuous clogging problems. Moreover, drain assemblies must be designed to prevent or at least minimize the escape of harmful microorganisms from the sewage system back into the plant. For example, many packing houses are confronted with serious problems of *Lysteria* contamination from floor drains.

Conventional gooseneck-type drain assemblies have proven to be troublesome in the context of industrial applications. These assemblies are prone to clogging, and studies have shown that they are susceptible to significant microorganism contamination.

There is accordingly a need in the art for an improved floor drain assembly especially designed for industrial applications in order to handle large volumes of particulate-laden waste streams.

SUMMARY OF THE INVENTION

The present invention overcomes the problems outlined above, and provides an improved floor drain assembly in the form of a body defining a passageway for conveying waste materials from a floor to a subfloor drainage or sewage assembly, wherein the assembly presents an inlet adapted for location adjacent floor level and an outlet below the inlet for coupling with the drainage or sewage assembly. The assembly includes a first oblique wall below the inlet and oriented for directing the flow of waste materials towards the outlet, together with a second upright wall spaced from the first oblique wall, with the first and second walls cooperatively defining a trap therebetween. A third wall is located intermediate the first and second walls in order to close the passageway above the level of waste materials within the trap.

In preferred forms, the oblique first wall extends across the majority of the surface area defined by the assembly inlet, and preferably at least about 75% of inlet surface area. The first wall is oriented at an angle of from about 30–60° relative to the horizontal, so that waste material impinging upon the oblique wall is forcefully diverted toward the discharge end of the assembly. The second space wall is also preferably oblique, with the two walls being divergent to cooperatively define the trap.

DETAILED DESCRIPTION OF THE PREFERRED EMBODIMENT

Figures 1, 2:
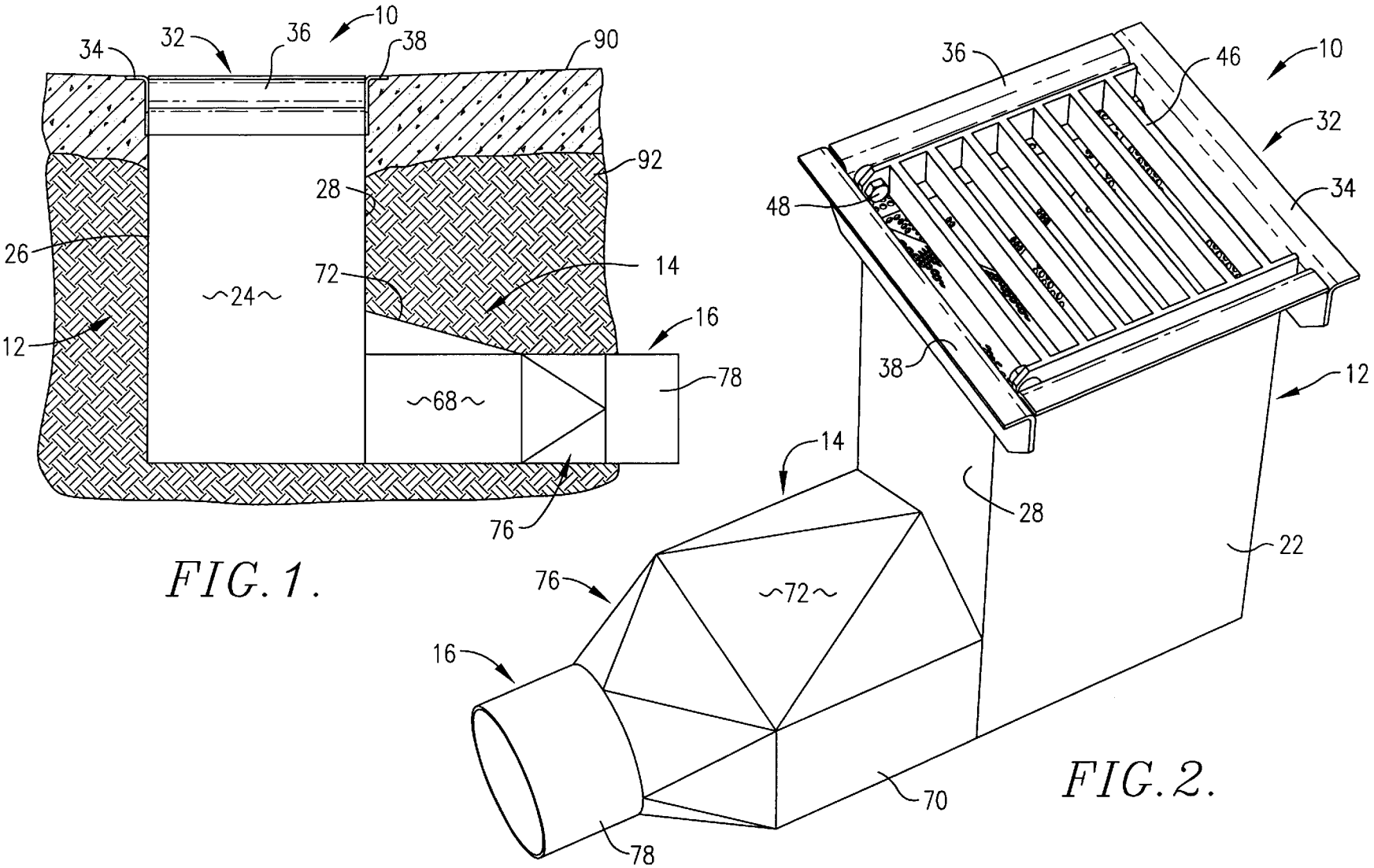
FIG. 1 is a side view of the preferred floor drain assembly of the invention, shown operatively mounted at and below the level of a floor.
FIG. 2 is an isometric view of the floor drain assembly illustrated in FIG. 1.

Turning now to the drawings, a floor drain assembly 10 in accordance with the invention broadly includes an upright inlet section 12, and outlet section 14 and a terminal discharge end 16, with a waste material trap 18 located between the inlet and outlet sections 12, 14.

Figure 3:
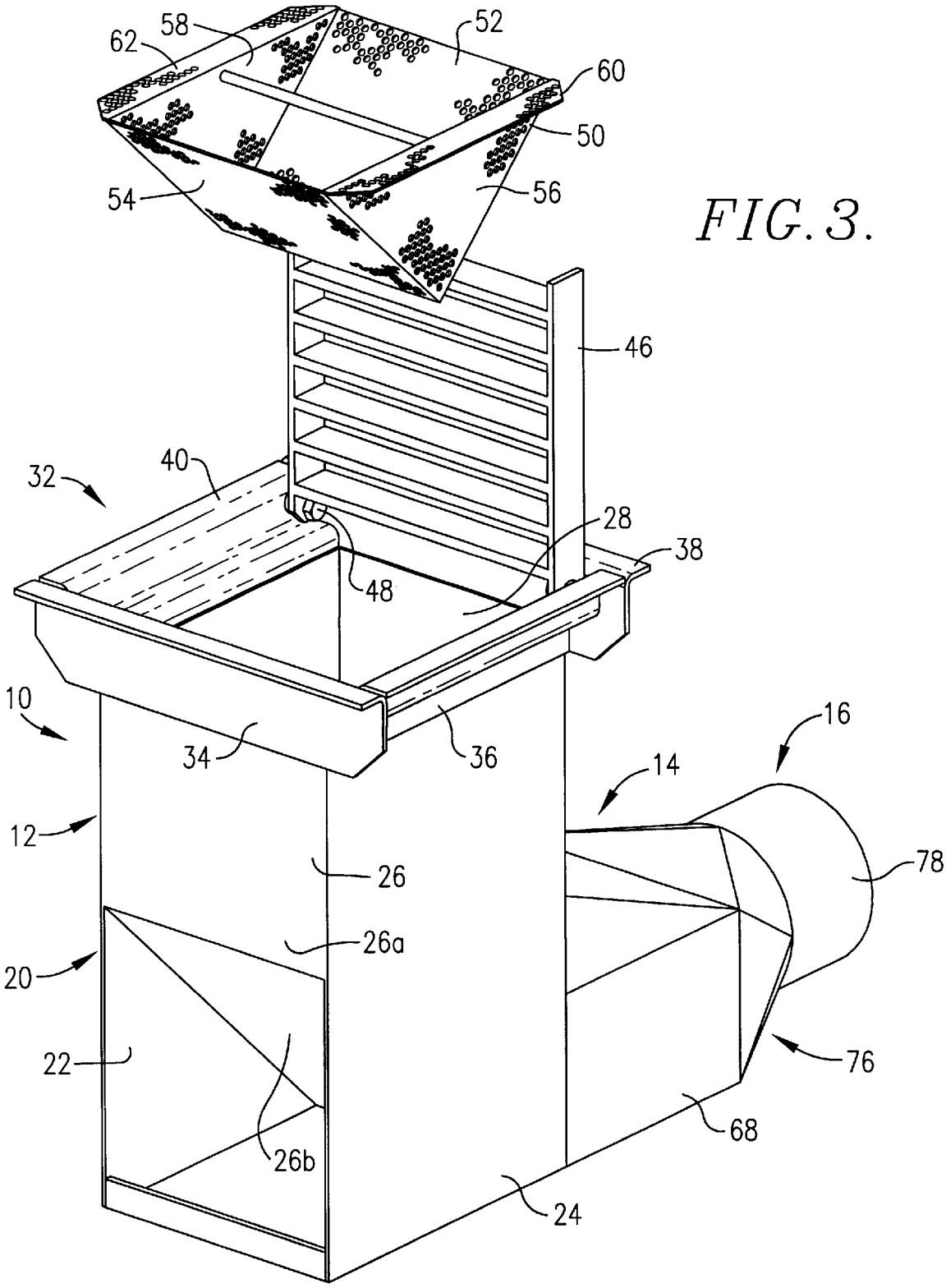
FIG. 3 is an isometric exploded view of the floor drain assembly.
Figure 4:
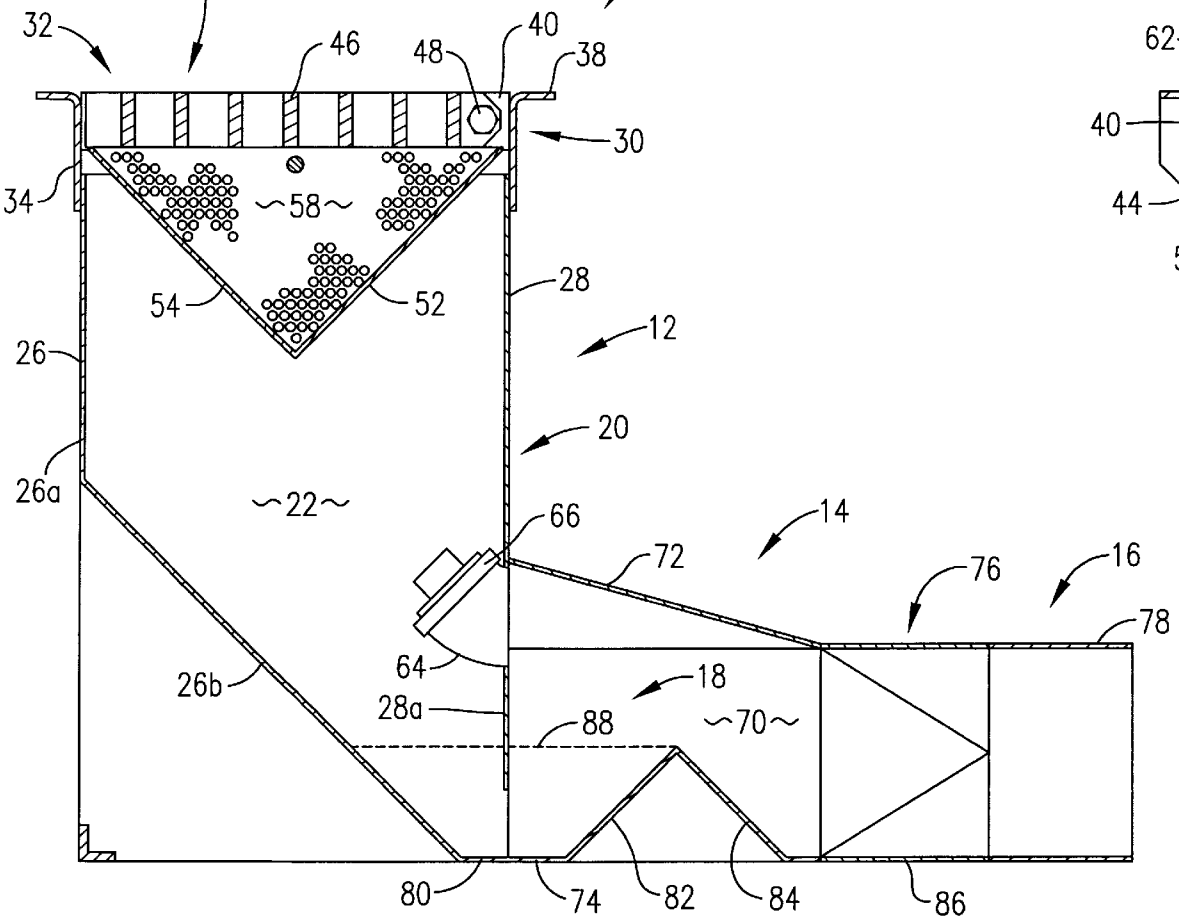
FIG. 4 is a vertical sectional view of the floor drain assembly.

In more detail, the inlet section 12 is in the form of a sheet metal body 20 including planar upright sidewalls 22, 24, rear wall 26 and front wall 28. The walls 22–28 cooperatively define an uppermost inlet 30, the latter being equipped with a frame and grate assembly 32. As best seen in FIG. 3, the assembly 32 includes respective elongated frame members 34, 36, 38, 40 which are interconnected and respectively secured to rear wall 26, sidewall 24, front wall 28 and sidewall 22. The frame members 34 and 38 are of inverted L-shaped configuration as best seen in FIG. 4, whereas the frame members 36 and 40 are of stepped configuration and present respective horizontal stretches 42, 44. A metallic grate 46 is secured to the opposed frame members 36, 40 by means of bolts 48 and extends across the inlet 30. This mounting permits pivoting movement of the grate 46 between an upper, open maintenance position shown in FIG. 3 and the usual closed position shown in the remainder of the Figures.

Figure 5:
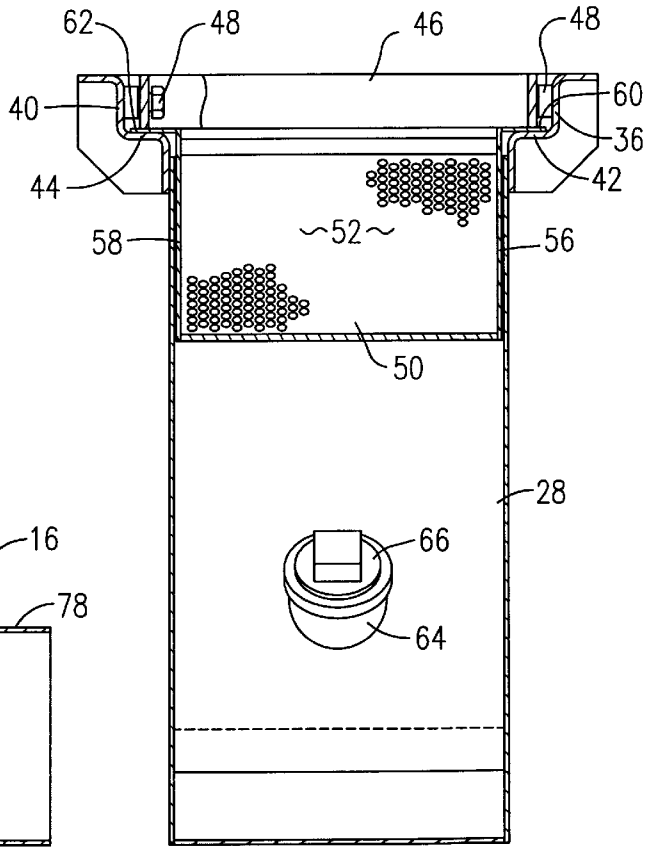
FIG. 5 is a fragmentary vertical sectional view of the floor drain assembly.

A perforate screen or filter 50 is also supported by the frame members 36, 40 and is located below grate 46. In particular, the filter 50 is generally V-shaped in cross-section, having obliquely oriented front and wall perforate segments 52, 54, perforate sidewall segments 56, 58, and laterally extending mounting flanges 60, 62 extending outwardly from each of the sidewalls segments 56,58. As best illustrated in FIG. 5, the flanges 60, 62 rest atop the frame member stretches 42, 44, beneath the grate 46.

The rear wall 26 includes an upright upper section 26*a* as well as an obliquely and downwardly extending lower section 26*b*. The section 26*b* is oriented at an angle of from about 30–60° relative to the horizontal, more preferably from about 40–50° and most preferably about 45°. The front wall 28 is essentially upright throughout its vertical extent, but is equipped with an upturned cleanout port 64 adjacent the outlet section 14. The port 64 is equipped with a removable cap 66.

The outlet section 14 includes upright sidewalls 68, 70, a sloped top wall 72 extending forwardly from front wall 28 and a bottom wall 74. The walls 68–74 include converging sections 76 remote from the inlet section 12, the latter terminating in a circular discharge 78. The bottom wall 74 includes a short, generally horizontal segment 80 extending forwardly from the lower end of oblique section 26*b*, as well as an upstanding wall 82 extending upwardly from the end of segment 80 remote from section 26*b*. Additionally, a downwardly extending oblique wall 84 is provided from the upper end of wall 82 downwardly to a flat, forwardly extending terminal segment 86. The wall 82 is preferably oriented at an angle of from about 30–60° relative to the horizontal, more preferably from about 40–50°, and most preferably about 45°. Wall 84 is obliquely oriented to the wall 82 and is located essentially orthogonally relative to the latter.

It will thus be appreciated that the trap 18 is cooperatively defined by the wall section 26*b* and wall 82, so that a liquid level illustrated by line 88 is maintained within the trap. Additionally, the lower section 28*a* of front wall 28 extends downwardly to a point below the liquid level 88, thereby blocking the drain assembly above the level 88.

In light of the foregoing, it will be seen that an oblique first wall (in the embodiment illustrated, wall section 26*b*) and an upright second wall (here, the wall 82) cooperatively define the trap 18, with a third wall (wall section 28*a*) between the first and second walls and closing the passageway above the level 88. Moreover, in preferred forms, the second wall is obliquely oriented with the first and second walls being divergent.

It has been found that the assembly 10 is capable of handling waste flows with a minimum of clogging problems. It is believed that the presence of the oblique wall section 26*b* (which extends across at least about 75% of the surface area defined by the inlet 30, and more preferably at least about 90% thereof) effectively diverts waste entering the inlet 30 towards the discharge end 16 with sufficient force to prevent most clogs. At the same time, the provision of the trap 18 prevents passage of sewer gas or the like backwardly through the assembly 10. In the event that a clog does occur, however, it is a simple matter to remove cap 66 and extend an auger through the port 64 for cleanout downstream of the trap 18.

The provision of the removable filter 50 also prevents large particulates from passing through and potentially clogging the assembly 10. That is, the pore size of the perforate walls making up the filter 50 permit passage of liquid and small particulates, but entrap larger materials. Of course, it is very easy to remove the filter 50 for cleaning or replacement, simply by pivoting the grate 46 upwardly and removing the filter as shown in FIG. 3.

The assembly 10 can be very inexpensively produced. In preferred forms, the assembly is made almost entirely of sheet metal, save for the grate 46 and filter 50. Similarly, installation of the assembly 10 is very simple. As shown in FIG. 1, the entire assembly is situated such that grate 46 and inlet 30 are essentially at the upper surface of floor 90, whereas the remainder of the assembly extends downwardly and is embedded in the earth 92 below the floor 90. Although not shown, it will be readily appreciated that the discharge 78 is adapted to be coupled with a conventional sewer line.

We claim:

1. A floor drain assembly comprising a body defining a passageway for conveying waste materials from a floor to a subfloor drainage or sewage assembly, said body presenting an inlet adapted for location adjacent the level of said floor and an outlet below said inlet and adapted for coupling to said drainage or sewage assembly, said body including a first oblique wall below said inlet and oriented for directing the flow of waste materials towards said outlet, a second upright wall presenting an upper end and spaced downstream from said first oblique wall, said first and second walls cooperatively defining a waste materials trap therebetween, and an upright third wall located intermediate said first and second walls and closing said passageway above the level of waste material within said trap, said first and third walls defining an open drainage space therebetween, there being a cleanout passageway extending through said upright third wall and communicating with said open space, said cleanout passageway being accessible through said body inlet.

2. The assembly of claim 1, said second wall being obliquely oriented.

3. The assembly of claim 1, including a fourth wall extending downwardly from the upper end of said second wall.

4. The assembly of claim 1, said first wall being generally planar and extending across at least about 75% of the surface area defined by said inlet.

5. The assembly of claim 1, said first wall being oriented at an angle of from about 30–60° relative to the horizontal.

6. The assembly of claim 5, said angle being from about 40–50°.

7. The assembly of claim 1, including a floor section located between said first and second walls.

8. The assembly of claim 1, said second wall being oriented at an angle of from about 30–60° relative to the horizontal.

9. The assembly of claim 8, said angle being from about 40–50°.

10. The assembly of claim 1, said first and second walls diverging from each other.

11. The assembly of claim 1, said third wall being substantially planar and extending from a point above the upper end of said second wall to a point below the upper end of the second wall.

12. The assembly of claim 1, including a perforate filter located below said inlet and above said first wall.

13. The assembly of claim 12, said filter being generally V-shaped in cross-section and having a pair of oblique, interconnected perforate segments.

14. The assembly of claim 13, one of said perforate segments being generally parallel with said first wall.

15. The assembly of claim 1, including a grate located across said inlet.

* * * * *